US005704093A

United States Patent [19]

Trulaske, Sr.

[11] Patent Number: 5,704,093

[45] Date of Patent: Jan. 6, 1998

[54] HANDLE FOR REFRIGERATION UNIT DOOR

[75] Inventor: Robert J. Trulaske, Sr., St. Louis, Mo.

[73] Assignee: True Manufacturing Company, Inc., O'Fallon, Mo.

[21] Appl. No.: 629,520

[22] Filed: Apr. 9, 1996

Related U.S. Application Data

[63] Continuation-in-part of Ser. No. 434,058, May 3, 1995, Pat. No. 5,553,354.

[51] Int. Cl.[6] ..... A47B 95/02; B65D 25/28

[52] U.S. Cl. ..... 16/110 R; 16/124

[58] Field of Search ..... 16/110 R, 124; 49/460, 501; 312/234.3, 332.1; 29/774

[56] References Cited

U.S. PATENT DOCUMENTS 3,117,339 1/1964 Vigna ..... 16/124

3,294,463 12/1966 Kafferlin et al. ..... 16/124

3,932,010 1/1976 Kenworthy ..... 16/124

3,969,009 7/1976 Radek ..... 16/124

*Primary Examiner*—Chuck Y. Mah

*Assistant Examiner*—Donald M. Gurley

*Attorney, Agent, or Firm*—Cohn, Powell & Hind

[57] ABSTRACT

This recessed handle (10) may find particular use for refrigeration units, such as freezers and coolers, and includes a front wall (14) having a cut-out wall portion (30) bent to extend inwardly about a bend line (42) to leave a compatibly configurated opening (50). The handle (10) includes an outer frame member (32) for the opening (50) and an inner frame member (34) for the cut-out wall portion (30). The frame members (32 and 34) cooperate to provide a re-entrantly formed portion opposite the bend line (42) providing a finger hold and the frame members are connected by threaded fasteners (94).

7 Claims, 3 Drawing Sheets

HANDLE FOR REFRIGERATION UNIT DOOR

This is a continuation-in-part of application Ser. No. 08/434,058 filed on May 3, 1995 now U.S. Pat. No. 5,553, 354.

BACKGROUND OF THE INVENTION

This invention relates generally to door handles for refrigeration units and particularly to a handle which is recessed into the door.

Conventional handles on free standing refrigeration units or cabinets such as freezers and coolers are generally fastened to the front wall of the refrigeration unit door and such handles are usually ell-shaped or U-shaped and provide a handgrip stem. While such handles are effective for opening the door they suffer from at least two disadvantages. One disadvantage is that they provide an outstanding projecting member on the door which can be easily hit by moving objects. The other is that such members are awkward for shipping purposes.

This refrigeration unit door handle solves these and other problems in a manner not revealed by the known prior art.

SUMMARY OF THE INVENTION

This invention provides a refrigeration unit door handle which is recessed and therefore does not present an outstanding member which can be hit by moving objects. In addition, the relatively flat door facilitates shipping. Further, the recessed handle is formed from an inwardly bent, cut-out portion of the front wall, and two connected frame parts, which are attached to the front wall of the door and to the cut-out, without the use of additional wall material and with a minimum of modification to the front wall.

This recessed handle includes a front wall having a planar surface including a wall portion defined by a bend line having opposed ends and a margin extending between said ends, the wall portion being bent inwardly about the bend line out of the plane of the front wall to provide an opening margin having substantially the same configuration as the wall portion margin; framing means having an outer frame covering the opening margin and an inner frame covering the wall portion margin, said framing means providing a re-entrantly formed portion disposed oppositely of the bend line, and means connecting said inner and outer frames.

It is an aspect of this invention that the re-entrantly formed portion provides a finger hold facilitating door opening.

It is another aspect of this invention to provide that the recessed handle includes a front wall having a planar surface and a wall portion defined by a bend line, an upper margin, a lower margin and a connecting margin disposed in spaced relation from the bend line to provide an opening having an upper margin, a lower margin and a connecting margin extending between the upper and lower margin to provide an inner recess wall, and framing means including an outer U-shaped frame having a bight member disposed adjacent the opening connecting margin, an upper arm member disposed adjacent the opening upper margin and a lower arm member disposed adjacent the opening lower margin, and an inner U-shaped frame having a bight member disposed adjacent the wall portion connecting margin, an upper arm member disposed adjacent the wall portion upper margin and a lower arm member disposed adjacent the wall portion lower margin.

It is another aspect of this invention to provide that the wall portion and the opening are generally rectangular and the wall portion is inwardly inclined.

It is still another aspect of the invention to provide that said inner frame includes an intermediate support member extending between the upper and lower arm members and receiving the wall portion in supported relation.

It is yet another aspect of this invention to provide that said connection means includes threaded fasteners extending between said inner frame and outer frame upper arm members and between said inner frame and outer frame lower arm members, and further to provide that said connection means includes guide pins extending between said inner and outer frame bight members.

It is an aspect of this invention to provide that said outer frame upper and lower arms include a vertical flange and a horizontal flange, said vertical flanges providing an abutment for said opening upper and lower margins, and said inner frame upper and lower arms include a vertical flange and a horizontal flange, said vertical flanges providing an abutment for said wall portion upper and lower margins.

It is another aspect of this invention to provide that said horizontal flanges of said outer frame are spaced from said vertical flanges of said inner frame to receive said upper and lower wall portion margins therebetween, and said horizontal flanges of said inner frame are spaced from said vertical flanges of said outer frame to receive said upper and lower opening margins therebetween.

It is still another aspect of this invention to provide that said outer frame horizontal flanges receive said inner frame horizontal flanges in nested relation.

It is yet another aspect of this invention to provide that said bight member of the outer frame includes a vertical member having front and rear portions defining a recess receiving the connecting margin of the opening, said vertical member providing a finger hold and said front portion providing a fascia member for said opening, and to provide that said outer frame upper and lower arms include a vertical flange, providing fascia members for said opening.

It is still another aspect of this invention to provide that said inner frame intermediate support member includes lug portions extending beyond said inner frame upper and lower arm members, said outer frame arm members include lug portions disposed adjacent associated lug portions of said inner frame, and said connecting means include threaded fasteners connecting associated inner and outer frame lug portions.

It is another aspect of this invention to provide that said outer frame bight member includes an inwardly directed flange and said inner frame bight member includes an outwardly directed flange engagable with said inwardly directed flange, and said connecting means includes spaced lug portions on each of said flanges defining pin and socket guide means.

It is another aspect of this invention to provide a method of forming a recessed handle for a refrigeration unit door having front and rear walls by forming a bend line on said front wall having opposed ends; cutting a wall portion from said front wall having a margin extending between said opposed bend line ends; bending said wall portion inwardly about said bend line to leave an opening margin having substantially the same configuration as said wall portion margin; framing said opening margin with an outer frame member; framing said wall portion margin with an inner frame member; and connecting said inner and outer frame members.

It is an aspect of this invention that the connecting means include spaced lug portions on each of said bight portions and threaded fastener means connecting said lug portions together.

It is another aspect of this invention that said inner frame upper and lower arms include a remote end, a connecting lug and a notched portion disposed in spaced relation from said remote end and a stiffening portion disposed adjacent said notched portion, and said outer frame upper and lower arms include a remote end, a connecting lug disposed in spaced relation from said remote end and received within said notched portion. It is another aspect that said stiffening portion extends on each side of said notched portion and has a graduated width and said connecting lug on said arms is attached to said horizontal flange and spaced from said vertical flange to receive the associated upper and lower margins of the front wall.

It is yet another aspect of this invention that a notched portion is disposed substantially at said remote end of each inner frame, and a tab is disposed substantially at said remote end of each outer frame and received within said associated notched portion. It is another aspect that said end tabs are attached to said horizontal flanges and spaced from said vertical flanges to receive the associated upper and lower margins of the front wall.

This recessed refrigeration unit handle is inexpensive to manufacture, simple to install and particularly effective for its intended purpose.

DESCRIPTION OF THE PREFERRED EMBODIMENT

Figure 3:
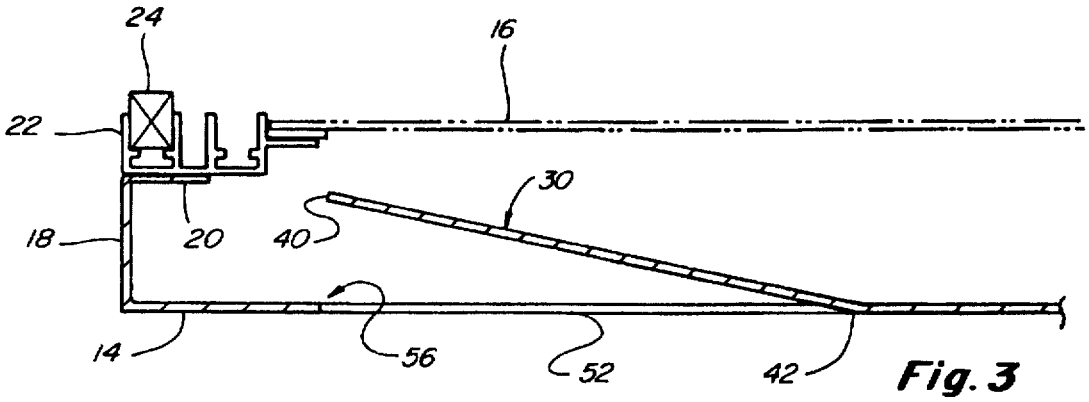
FIG. 3 is a cross-sectional view taken on line 3—3 of FIG. 1 prior to installation of the handle frames.
Figure 4:
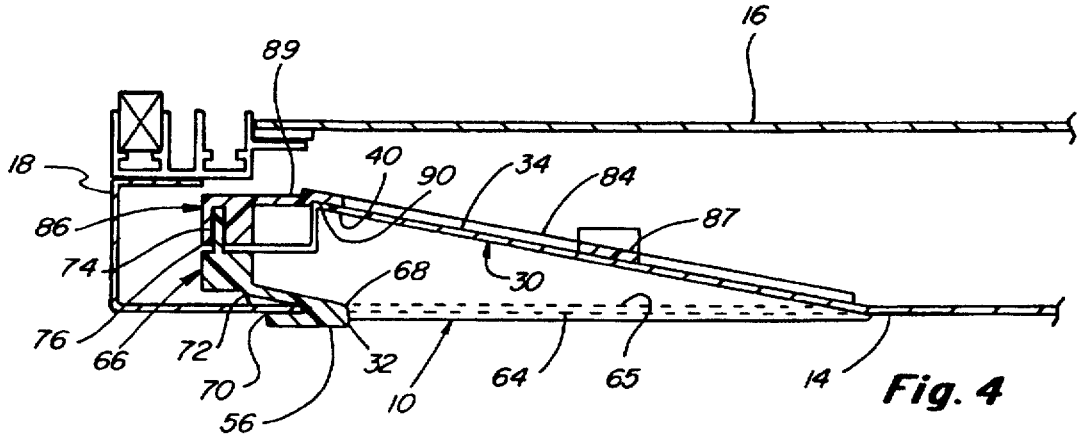
FIG. 4 is a similar view to FIG. 3 with the handle frames installed.

Referring now by reference numerals to the drawings and first to FIGS. 1 and 3–5, it will be understood that a refrigeration unit, such as a freezer 1, includes a front door 2, said door being provided with a recessed handle 10. As shown in FIG. 3, the door 2 includes a generally planar front wall 14 and a generally planar rear wall 16, the front wall 14 being re-entrantly formed to provide an end wall 18 and an offset stub wall 20. The rear wall 16 and the offset stub wall 20 cooperate to receive an extruded retainer 22 of plastic, or the like, for a gasket 24 of rubber or similar material. In the preferred embodiment, the walls are formed of metal, such as stainless steel.

The recessed door handle 10, shown in detail in FIGS. 2 and 4– 7, is symmetrical about its horizontal axis and is formed from a rectangular portion 30 of the outer wall 14 and outer and inner U-shaped frames 32 and 34, formed from plastic, or the like. The rectangular wall portion 30 is die cut from the outer wall 14 and includes upper and lower margins 36, and a vertical margin 40 connecting the upper and lower margins 36. The wall portion 30 is inwardly bent about a vertical bend line 42, which defines the wall portion 30 and also the opening 50 remaining after the wall portion 30 is bent inwardly. The opening 50 includes upper and lower margins 52, and a vertical margin 56 connecting said upper and lower margins 52.

Essentially, the opening 50 is edged by the outer frame 32 and the wall portion 30 is edged by the inner frame 34, the wall portion 30 forming the rear wall of the recessed door handle and the frames 32 and 34 cooperating to provide the upper, lower and vertical wall portions of the recessed door handle 10, as will now be described with reference to FIGS. 2–8.

Figure 8:
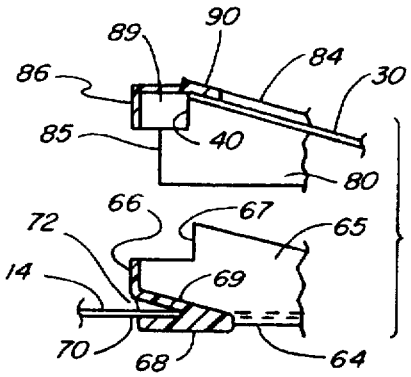
FIG. 8 is a fragmentary cross-sectional view taken on line 8—8 of FIG. 1.
Figure 5:
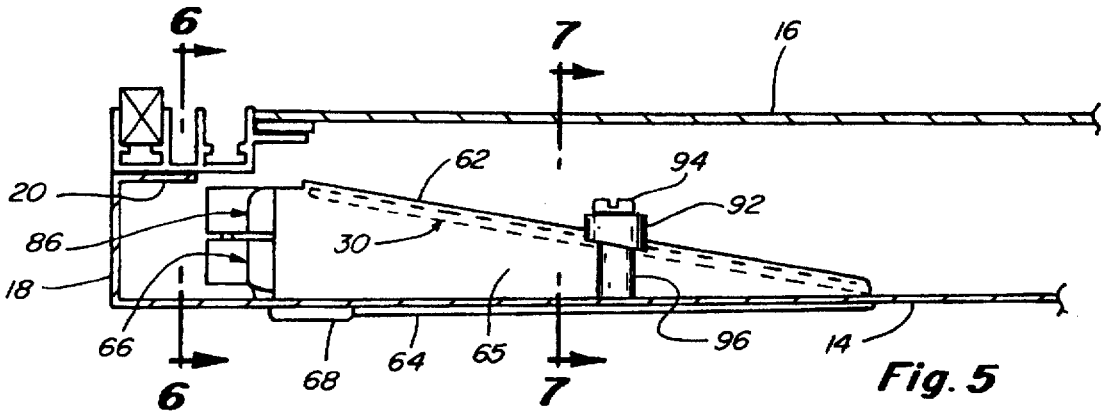
FIG. 5 is a cross-sectional view taken on line 5—5 of FIG. 1 with the handle frames installed.

The outer frame 32 includes upper and lower members 62, formed in mirror image of each other, and a vertical member 66. As shown in FIG. 5, the vertical member 66 includes an outer, fascia member 68 and an inner member 69 separated by a recess 70 receiving the vertical margin 56 of the opening 50. In the embodiment shown, the recess 70 is provided with vertically spaced guide lugs 72 to facilitate the reception of the vertical margin 56 of the opening 30. The upper and lower frame members are generally ell-shaped to include vertical flanges 64 and horizontal flanges 65 notched at 67 as shown in FIG. 8.

Figure 7:
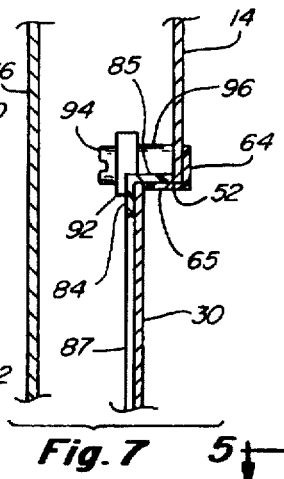
FIG. 7 is fragmentary cross-sectional view taken on line 7—7 of FIG. 5.

The inner frame 34 includes upper and lower members 82 formed in mirror image of each other, a vertical member 86 and an intermediate member 87. The vertical member 86 includes an inner member 88 having turned-in ends 89 and an abutment member 90 providing an elongate face receiving the vertical margin 40 of the wall portion 30. The upper and lower frame members 82 are generally ell-shaped to include vertical flanges 84 and horizontal flanges 85. As shown in FIGS. 7 and 8, the horizontal flanges 85 of the inner frame 34 receive the corresponding horizontal flanges 65 of outer frame 32 in nested relation, the notch 67 accommodating the upper and lower turned-in ends 89 of member 88.

The outer frame vertical member 66 includes a plurality of spaced lug portions 75 providing guide pins 74 and the inner frame vertical member 86 includes spaced lug portions 73 providing associated sockets 76, which receive said guide pins 74.

With this structural arrangement of parts, the outer frame upper and lower vertical flanges 64 provide a cover for the upper and lower margins 52 of the opening 30 which are held in place by the horizontal flanges 85 of the inner frame 34. Similarly, the inner frame upper and lower vertical flanges 84 provide a cover for the upper and lower margins 36 of the inwardly bent plate portion 30 which are held in place by the horizontal flanges 65 of the outer frame.

Figure 2:
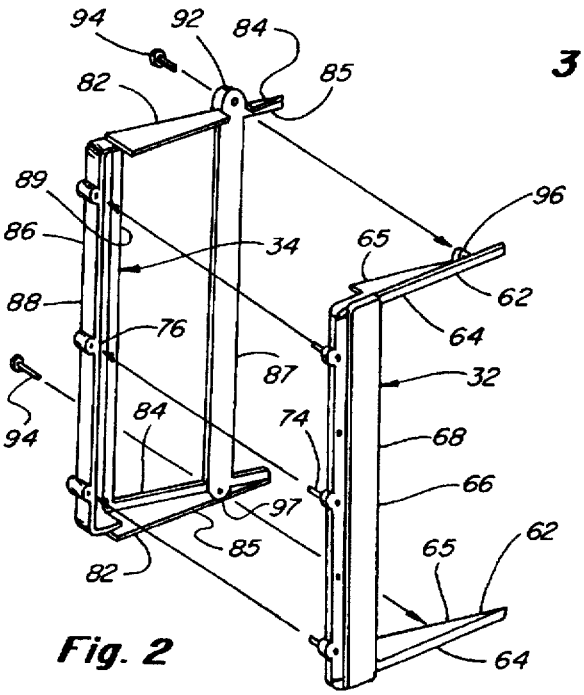
FIG. 2 is an exploded perspective view of the handle inner and outer frames.
Figure 1:
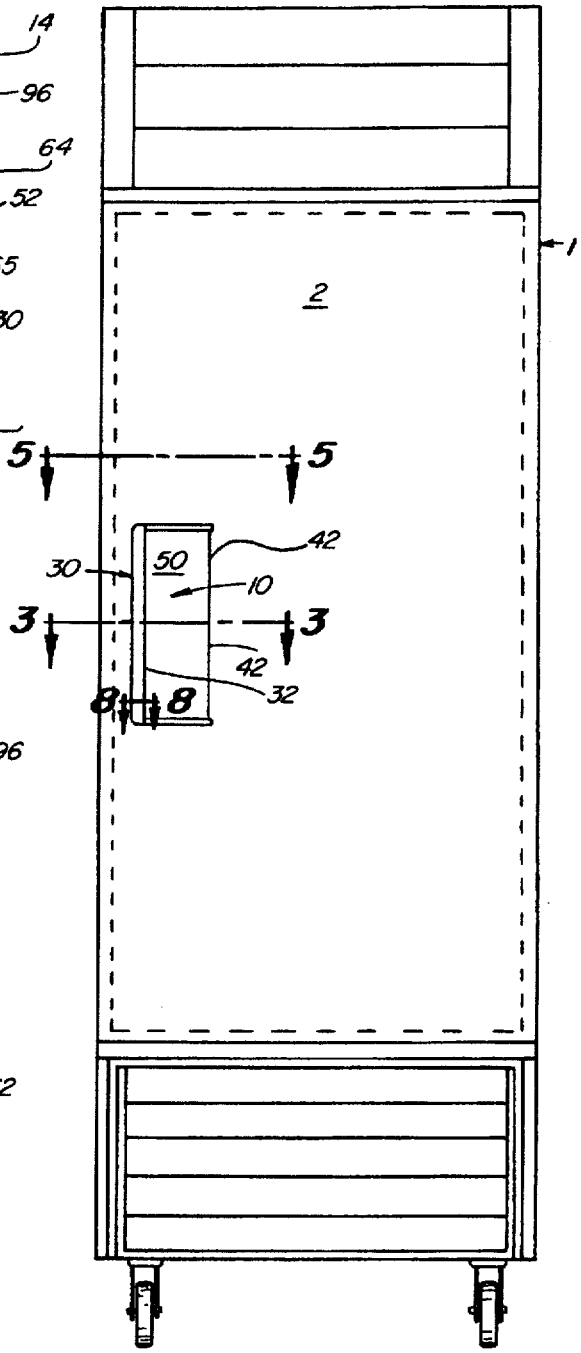
FIG. 1 is a front elevational view of a refrigeration unit door employing the recessed door handle.

In the preferred embodiment, the inner and outer frame members 32 and 34 are connected together in such a manner as to hold each other and the margins of the inwardly bent plate portions securely in place. In this regard, the inner frame intermediate member 87 includes outer end lugs 92 extending beyond the upper and lower members 82 and apertured to receive fasteners 94. The outer frame includes corresponding lugs 96, which are attached to the horizontal flange 65, and received within the associated inner frame horizontal flange 85 notched portion 97 and disposed in aligned relation with lugs 92 and are apertured to receive said fasteners 94 in threaded relation. As shown in FIGS. 2 and 7, the flanges 85 and lugs 96 are spaced from the vertical legs 64 of the outer frame 32 to receive and hold the upper and lower margins of the opening 30. This arrangement provides a connecting means for holding the inner frame 34 and the outer frames 32 securely together following emplacement over the margins of the wall portion 30 and the opening 50 respectively.

With the above arrangement, the outer frame member bight portion 66 provides an inner re-entrantly formed surface 69 which provides a finger hold facilitating the opening of the door.

FIGS. 9–13 illustrate a modified handle which is generally similar to the handle discussed above with respect to FIGS. 1–8 but includes additional features. Because the inner and outer frames are generally similar, the same reference numerals will be used except for the addition of a prefix numeral "1". As with previous embodiment the inner and outer frames are symmetrical and accordingly it is not necessary to describe the upper and lower parts of said frames.

The modified handle 110 is different from the handle discussed above with respect to the nature of the connection between the outer and inner frames 132 and 134; the stiffening of the inner frame 132 in the vicinity of the notched horizontal flange 185 receiving the lug 196; and the additional holding means for the upper and lower margins 52 of the opening 50 in the vicinity of the vertical bend line 42.

Figure 9:
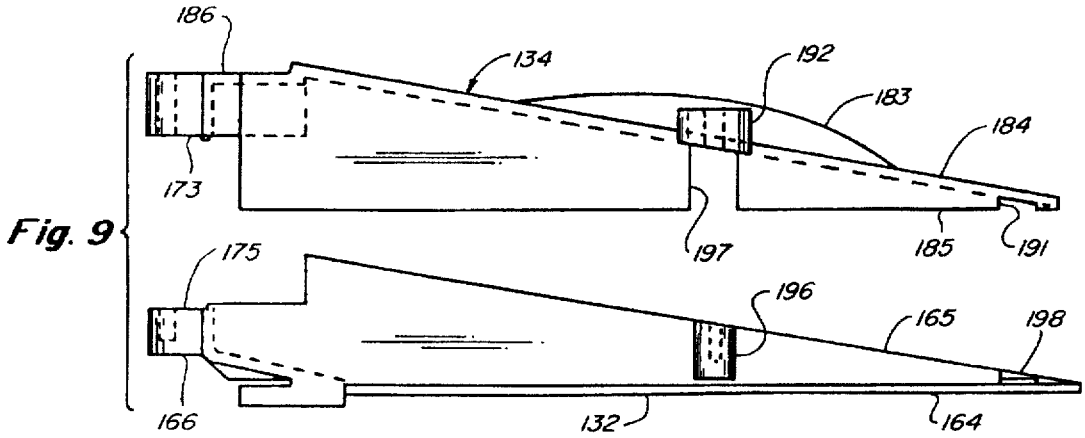
FIG. 9 is a plan view of the inner and outer frames of a modified handle prior to installation.
Figure 10:
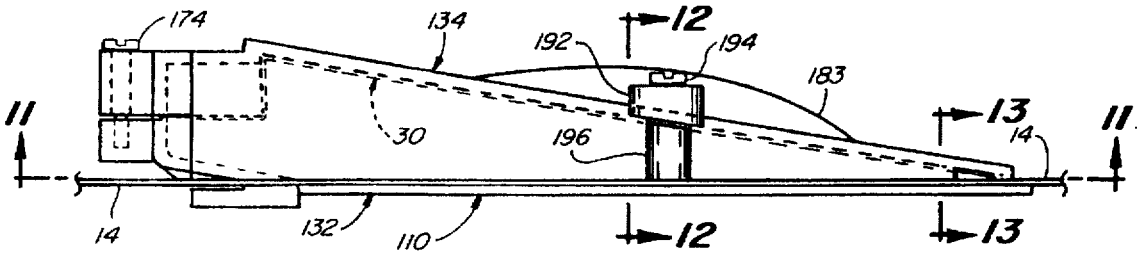
FIG. 10 is a plan view of a modified handle inner and outer frames following installation.
Figure 11:
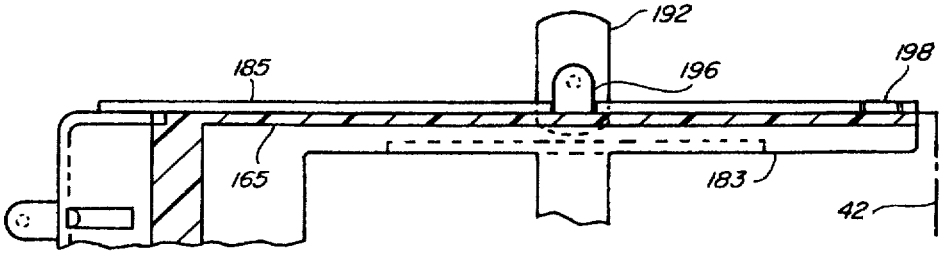
FIG. 11 is a cross-sectional view taken on line 11—11 of FIG. 10.
Figure 12:
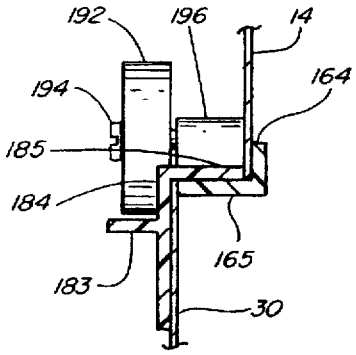
FIG. 12 is a cross-sectional view taken on line 12—12 of FIG. 10.

With respect to the connection between the lugs 175 and 173 a threading fastener 174 is used, rather than guide pins. As shown in FIG. 9, a clearance hole is provided in lug 173 and a smaller diameter blind hole is used in lug 175 to effectuate connection of the lugs by the fastener 174, similar to the connection between lugs 192 and 196.

In order to provide additional strength for the horizontal flange 185 in the vicinity of the notch 197, an arcuate, generally segmental-shaped rib 183 is molded into the vertical flange 184. As clearly shown in FIG. 9 the stiffening rib has a graduated width, being a maximum in the notched area of the horizontal flange 185. This structural arrangement of parts ensures that the inner frame 134 provides superior resistance to any push exerted by the wall portion 30.

Figure 13:
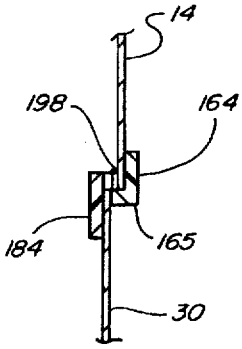
FIG. 13 is a cross-sectional view taken on line 13—13 of FIG. 10.

In order to provide additional holding for the upper and lower margins of the opening 50 in the vicinity of the bend line 42 an end tab 198 is provided which has a similar purpose to the lug 196 disposed intermediate the member 132. In this regard, the generally triangular end tab 198 is molded onto the horizontal flange 165 and spaced from the vertical flange 164 to receive the opening margin 36 of the front wall 14 and hold the handle tight against said wall. This arrangement is best shown by reference to FIGS. 9 and 13. As also shown in FIGS. 9 and 13, the horizontal upper flange 185 is notched at 191 to receive the molded tab 198.

In other respects, the modified handle is generally identical to the handle shown in FIGS. 1–8.

It is thought that the structural features and functional advantages of this recessed handle 10 have become fully apparent from the foregoing description of parts but for completeness of disclosure the installation of the assembly will be briefly described with reference to FIGS. 2–8.

Figure 6:
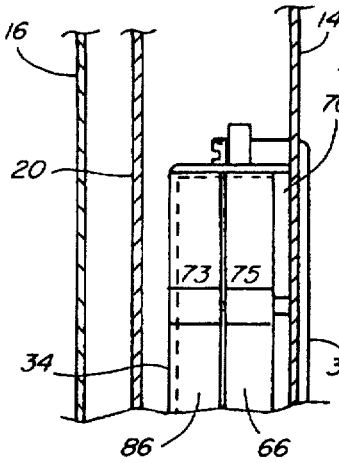
FIG. 6 is a fragmentary cross-sectional view taken on line 6—6 of FIG. 5.

As indicated in FIG. 6, prior to attachment of the rear wall 16, shown in phantom outline, the plate portion 30 is accessible from both the front and the rear. Initially, the bend line 42 is formed on the front wall 14 having opposed ends, and the wall portion 30 is cut from the front wall 14, said wall portion having horizontal and vertical margins 36 and 40 extending between the ends of the bend line, and said wall portion being bent inwardly about said bend line to leave an opening having horizontal and vertical margins 52 and 56 with substantially the same configuration as said wall portion margins. The outer frame 32 is then slipped into place from the front, toward the end 18, so that the vertical and horizontal margins 56 and 52 of the opening 50 are received by the frame vertical recess 70 and the gaps between the outer frame lugs 96 and the frame vertical members 64, respectively, so that the frame fascia members 68 and 64 cover said opening margins. Next, the inner frame 34 is slipped into place from the rear, away from the end 18 until the vertical and horizontal margins of the plate portion 30 are received in front of the vertical abutment 90, the vertical legs 84 and the intermediate vertical member 87, and held by the horizontal legs 65, such that the guide pins 74 are aligned with the guide sockets 76 and the frame 34 lug openings are aligned with the frame 32 lug openings. Finally, the two frames 34 and 32 can then be pushed together and connected by the fasteners 94 such that the plate portion 30 margins are held between the two frames. It will be understood that the installation is facilitated by the flexibility of the plate portion 30 and the accuracy of the margins due to the die cut of the plate portion.

In the embodiment shown in FIGS. 9–13, the frame bight portions are connected by threaded fasteners 174 in lieu of guide pins, the inner frame upper and lower members 182 are reinforced by stiffening ribs 183 and an end tab 198 provides additional holding of the opening upper and lower margins in the vicinity of the bend line 42.

Although the invention has been described by making detailed reference to the preferred embodiments, such detail is to be understood in an instructive rather than in any restrictive sense, many other variants being possible within the scope of the claims hereunto appended.

I claim as my invention:

1. A recessed handle for a refrigeration unit door, comprising:

(a) a front wall having a planar surface and including a wall portion defined by a bend line, an upper margin, a lower margin and a connecting margin disposed in spaced relation from the bend line, said wall portion being cut from the front wall and bent inwardly about the bend line out of the plane of the front wall to provide an opening having an upper margin, a lower margin and a connecting margin extending between the upper and lower margin to provide an inner recess wall, (b) framing means including an outer frame having a bight portion disposed adjacent the opening connecting margin, an upper arm portion disposed adjacent the opening upper margin and a lower arm portion disposed adjacent the opening lower margin, and an inner frame having a bight portion disposed adjacent the wall portion connecting margin, an upper arm portion disposed adjacent the wall portion upper margin and a lower arm portion disposed adjacent the wall portion lower margin, and (c) means connecting said inner and outer frames.

2. A handle as defined in claim 1, in which:

(d) said outer frame bight portion includes an inwardly directed flange and said inner frame bight portion includes an outwardly directed flange disposed adjacent to said inwardly directed flange, and (e) said connecting means include spaced lug portions on each of said flanges and fastener means connecting said lug portions together.

3. A handle as defined in claim 2, in which:

(f) said lugs are spaced from each other and the connecting fastener means are threaded fasteners.

4. A handle as defined in claim 1, in which:

(d) said inner frame upper and lower arm portions include a remote end, a connecting lug and a notched portion disposed in spaced relation from said remote end and a stiffening portion disposed adjacent said notched portion, and (e) said outer frame upper and lower arm portions include a remote end, a connecting lug disposed in spaced relation from said remote end and received within said notched portion.

5. A handle as defined in claim 4, in which:

(f) said inner frame upper and lower arm portions include a vertical and transverse flange and said stiffening portion extends oppositely of said transverse flange on each side of said notched portion and has a graduated width (g) said outer frame upper and lower arm portions include a vertical and transverse flange and said connecting lug is attached to said transverse flange and spaced from said vertical flange to receive the associated upper and lower margins of the front wall.

6. A handle as defined in claim 1, in which:

(d) said inner frame upper and lower arm portions include a remote end, and a notched portion disposed substantially at said remote end, and (e) said outer frame upper and lower arm portions include a remote end, a tab disposed substantially at said remote end and received within said notched portion.

7. A handle as defined in claim 6, in which:

(f) said inner frame upper and lower arm portions include a vertical and transverse flange, said transverse flange having said notched portion, and (g) said outer frame upper and lower arm portions include a vertical and transverse flange and said end tab is attached to said transverse flange and spaced from said vertical flange to receive the associated upper and lower margins of the front wall.

* * * * *